United States Patent [19]

Mead et al.

[11] Patent Number: 4,831,717

[45] Date of Patent: May 23, 1989

[54] COMMUTATOR ALIGNMENT FIXTURE

[75] Inventors: Richard A. Mead, Granville; James L. Nobles, Reynoldsburg, both of Ohio

[73] Assignee: Resinoid Engineering Corporation, Newark, Ohio

[21] Appl. No.: 66,005

[22] Filed: Jun. 24, 1987

[51] Int. Cl.[4] ..... H01R 43/06

[52] U.S. Cl. ..... 29/597; 29/733; 29/598

[58] Field of Search ..... 29/597, 733, 598

[56] References Cited

U.S. PATENT DOCUMENTS 4,484,389 11/1984 Kogej et al. ..... 29/597

*Primary Examiner*—Carl E. Hall

*Assistant Examiner*—Taylor J. Ross

*Attorney, Agent, or Firm*—Wood, Dalton, Phillips, Mason & Rowe

[57] ABSTRACT

A commutator alignment fixture includes a cylindrical bore having a plurality of axial circumferentially spaced blades extending inward from a side wall thereof. The circumferential spacing of the blades is determined according to the circumferential spacing of longitudinally extending, circumferentially spaced slots in a commutator wherein the alignment fixture blades coact with the commutator slot to axially slidably support the commutator in known circumferential orientation to the armature winding and core location when the commutator assembly is press-fit onto an armature shaft so that the commutator slots are in circumferential orientation with respect to the slots on the armature.

19 Claims, 2 Drawing Sheets

FIG. 1
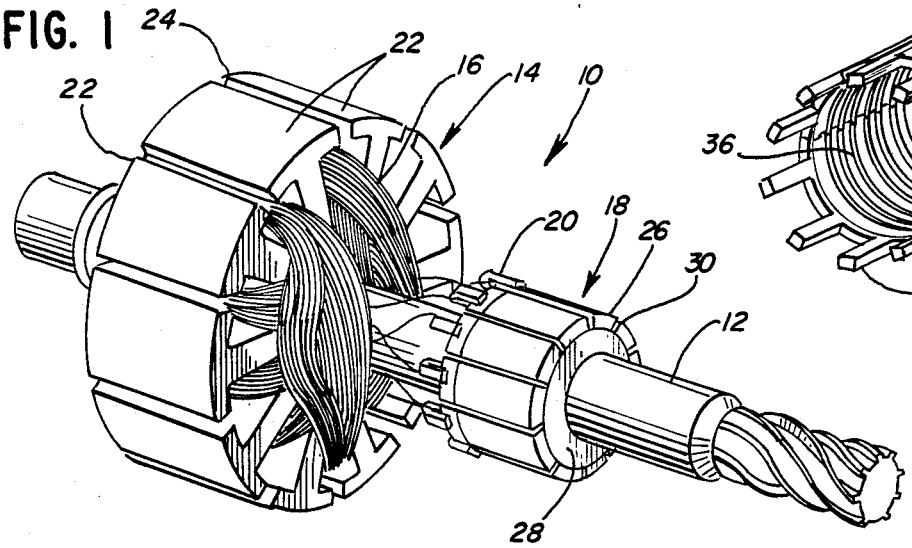
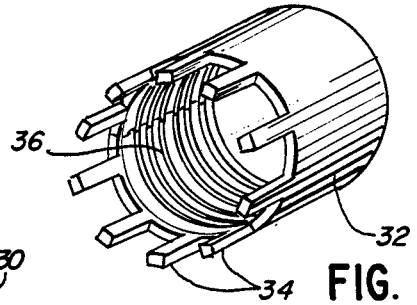
FIG. 2
FIG. 3
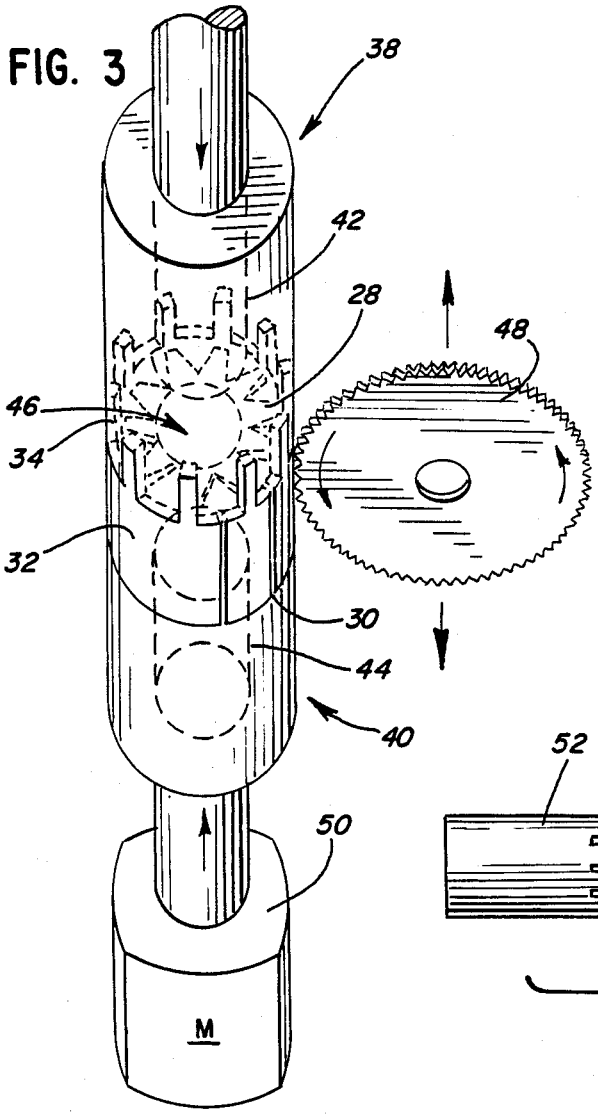
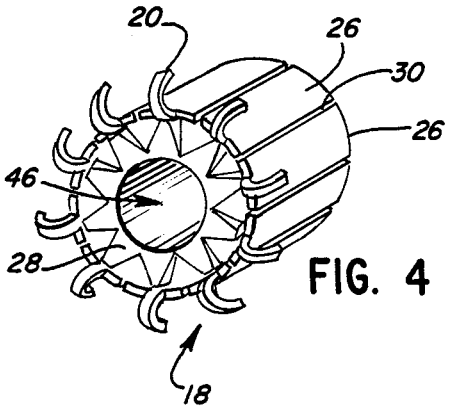
FIG. 4
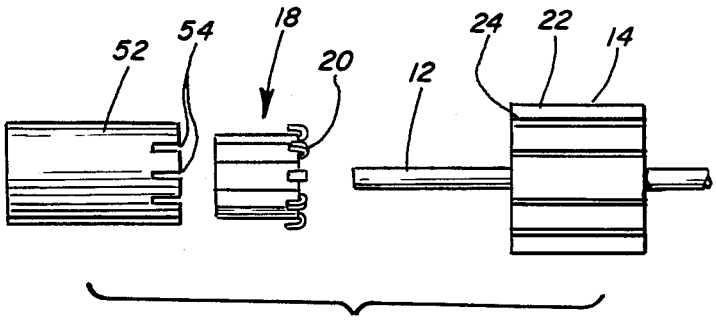
FIG. 5
PRIOR ART FIG. 6
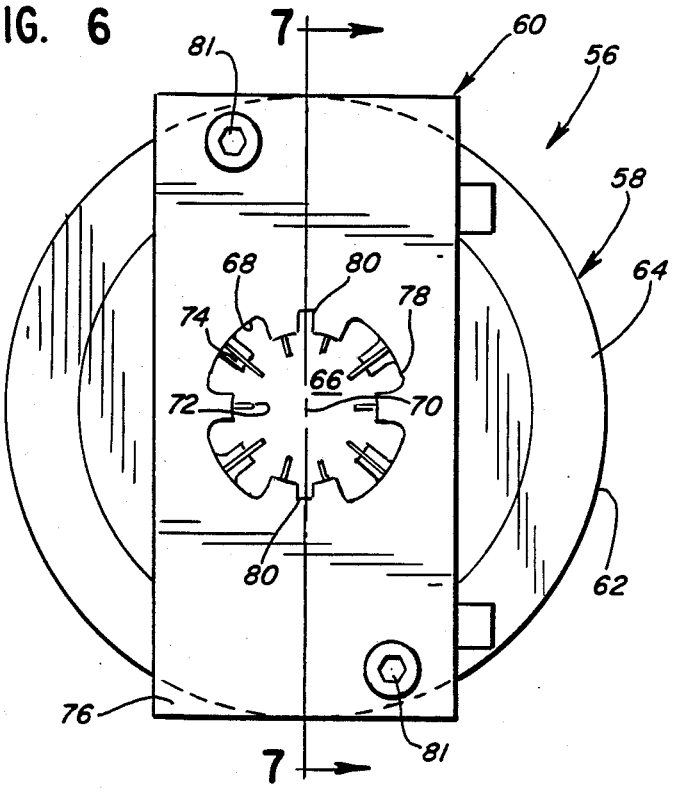
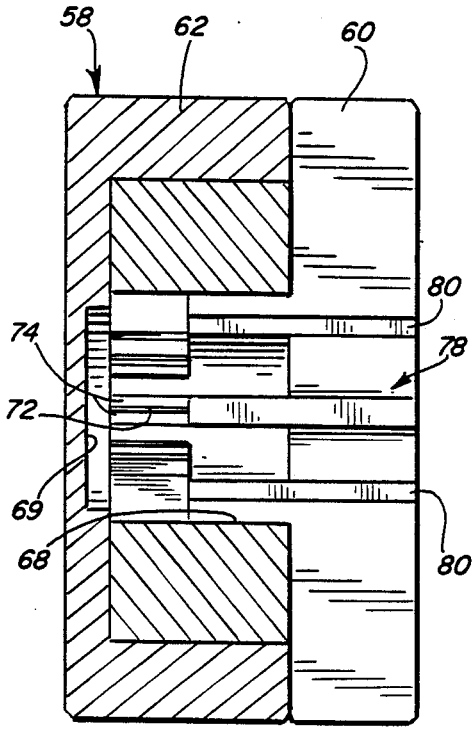
FIG. 7
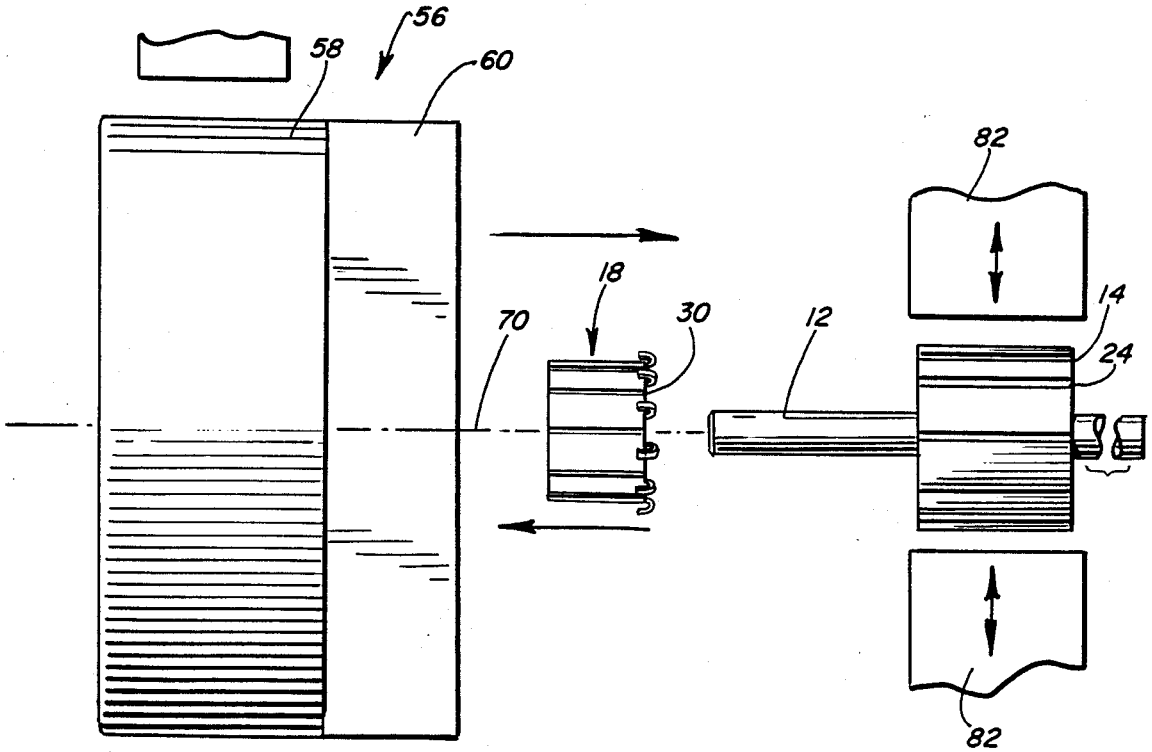
FIG. 8

COMMUTATOR ALIGNMENT FIXTURE

FIELD OF THE INVENTION

This invention relates generally to the assembly of motor armatures, and more particularly to a fixture for aligning the slots in a commutator with respect to the slots of an armature core.

BACKGROUND OF THE INVENTION

In a brush-type motor, alternate magnetic attraction and repulsion between poles in the armature and stator cause the armature to rotate when a current flows through the stator and armature windings. The current flow through the armature windings must continually be reversed to provide such an alternate action. A commutator and brushes are used to continually and alternately switch the current in the armature windings as the armature rotates. A conventional commutator includes commutator segments, separated by slots, disposed around an insulating core press-fit onto the armature shaft, with wire tangs or hooks connecting each segment to the armature windings.

Armature reaction varies according to the geometry and symmetry of the armature windings and the commutator segment position. For efficient motor operation the commutator must be precisely circumferentially positioned on the armature shaft with respect to the armature core position to minimize any effects of armature reactions. In an attempt to properly align commutators on armature shafts, manufacturers have aligned commutators according to the positions of the tangs with respect to a known position for the armature poles or slots. One of the problems with this procedure is that the tang position with respect to its associated comutator segment depends on the accuracy of the metal forming operation and metal stamping operation utilized in constructing the commutator. As described in Wojcik co-pending U.S. patent application Ser. No. 855,393, the slots which define the segments are typically cut into the commutator as one of the last steps in the commutator assembly. Thus, the inaccuracies resulting from the metal forming operation, the stamping operation, and slot positioning operation accumulate which may result in inaccurate positioning of the tangs with respect to each commutator segment.

An alternative approach to aligning the commutator relies on the circumferential alignment of a single commutator slot with respect to a known armature position. It is believed that such an alignment procedure results in a more accurate positioning of the commutator, to provide more precise switching of armature current, resulting in more efficient motor operation than obtained by keying upon tangs for alignment.

One known method for aligning the commutator according to slot position utilizes an optical sensor to accurately position a single commutator slot relative to a known armature core position. This procedure requires an accurate light source, such as a laser, which is expensive. Moreover, this method assures only that a single commutator slot will be aligned properly. If the circumferential spacing between slots is not identical, then improper alignment may result, again rendering the motor less efficient than it could be should each bar be properly aligned with the armature winding.

The above described problems while important in a two pole motor, are even more critical in a motor having a greater number of poles. With a four pole motor, the armature current, and thus armature voltage, goes through two complete cycles each revolution. Therefore, to balance armature reactions between sets of poles there must be a more precise orientation than with a two pole motor.

The present invention is directed to overcoming these and other problems relating to motor armature construction.

SUMMARY OF THE INVENTION

It is an object of the present invention to provide an alignment fixture for circumferentially accurately orienting a plurality of commutator slots with respect to a known armature position when the commutator is press fit onto an armature shaft.

Broadly, there is disclosed herein an alignment fixture for holding a cylindrical commutator having equally circumferentially spaced axial slots in circumferential orientation when the commutator is press-fit onto an armature shaft so that the commutator slots are in circumferential alignment with slots on an armature which is carried by the shaft. The fixture includes a receptacle having a front face with a cylindrical bore therethrough. The bore has a cylindrical wall and a center line, with a radius between the center line and the wall which is greater than the radius of the commutator. A plurality of elongated blades are provided with each blade having a width slightly less than the width of the commutator slots. Means are associated with the bore wall for supporting the blades in axial alignment with respect to the center line and circumferentially spaced according to the circumferential spacing between the slots on the commutator. Accordingly, the blades coact with the slots to axially, slidably support a commutator in circumferential orientation when the commutator is press-fit onto an armature shaft.

Another object of the present invention is to provide an alignment fixture having a blade for each commutator slot.

It is yet another object of the present invention to provide an alignment fixture that has the blades equally circumferentially spaced from one another.

It is a further object of the present invention to provide an alignment fixture having at least two blades not in the same plane.

It is still another object of the present invention to provide means for preorienting a commutator so that the commutator slot are in general alignment with the blades.

It is an additional object of the present invention to provide a method of assembling a commutator and a motor armature. This method includes the steps of providing an armature core having a plurality of circumferentially spaced slots, and a commutator shell with a central longitudinal opening therein. A plurality of longitudinal equally circumferentially spaced slots are cut in the commutator shell. The armature shaft is placed in an assembly machine armature clamping fixture with the armature slots in a predetermined circumferential orientation. An alignment fixture is included in the machine in a predetermined circumferential orientation relative to the armature clamping fixture. The commutator shell is radially directed into the alignment fixture, the alignment fixture including a plurality of orientation blades for coacting with the commutator slots to hold the commutator in a predetermined circumferential orientation. Relative axial movement is imparted between the armature shaft and the alignment fixture so that the commutator shell is force fitted or pressed onto the armature shaft with the commutator slots in circumferential alignment with the armature slots. The act of pressing the commutator onto the shaft through the alignment fixture assures slot alignment between armature and commutator within a degree of accuracy not heretofore achieved on a production line basis.

Further features and advantages of the invention will readily be apparent from the specification and drawings.

BRIEF DESCRIPTION OF THE DRAWINGS

FIG. 1 is a perspective view of a motor armature incorporating a commutator assembly;

FIG. 2 is a perspective view of a commutator shell completely formed into a cylinder;

FIG. 3 is an exploded perspective view of a commutator slotting operation according to the present invention;

FIG. 4 is a perspective view of a completed commutator assembly;

FIG. 5 is an exploded view illustrating a prior art method of assembling a commutator to an armature shaft;

FIG. 6 is a plan view of an assembly machine nose-piece according to the present invention;

FIG. 7 is a sectional view taken along lines 7—7 in FIG. 6; and

FIG. 8 is an exploded view of a method of assembling a commutator to an armature shaft, according to the present invention.

DETAILED DESCRIPTION OF THE PREFERRED EMBODIMENT

Referring to FIG. 1, a completed armature assembly 10 is illustrated. The armature assembly 10 is typically utilized in small general purpose motors, such as for small appliances. The armature assembly 10 includes an armature shaft 12, an armature core 14 having windings 16 thereon, and a commutator 18. The commutator 18 includes tangs or hooks 20 connecting the armature windings 16 to the commutator 18. The armature core 14 comprises a plurality of poles 22 having accurately formed and spaced armature slots 24 therebetween.

The commutator 18 includes a plurality of commutator segments 26 secured to an insulating commutator core 28. A commutator slot 30 is provided between each adjacent pair of commutator segments 26. One such commutator assembly and method of manufacturing same is described in Wojcik co-pending U.S. patent application Ser. No. 855,393, assigned to the assignee of the present invention, the specification of which is hereby incorporated by reference.

In a conventional assembly operation, the armature core 14 is secured to the shaft 12 by any known means. Thereafter, the commutator 18 is secured to the shaft 12 in a press interference fit such that the commutator segments 26 and the armature poles 22 are generally in circumferential alignment. The accuracy of the alignment between commutator segments 26 and the armature poles 22 determines, in part, the efficiency of operation of a motor into which the armature assembly 10 is placed. According to the present invention, an alignment fixture is described which can be utilized in a method of assembling a commutator to an armature shaft whereby the commutator and armature core are aligned by aligning a plurality of commutator slots with respect to a known armature position.

Referring to FIG. 2, an intermediate step in the assembly of a commutator 18 is illustrated. A severed length of a rolled ribbon of electrically conductive material, such as copper, is shaped into a complete cylinder of the precise dimensions for the commutator shell. A series of equally spaced arms 34 extend upwardly from the cylinder 32. A rib and groove pattern 36 is evident on the inner surface of the cylinder 32. Thereafter, an insulating commutator core 28 (see FIG. 2) is molded on the inside of the commutator shell.

Referring to FIG. 3, a slotting operation for the commutator shell 32 is illustrated. The commutator shell 32 is firmly held in place between an upper fixture 38 and a lower fixture 40. Both the upper and lower fixtures 38 and 40 include piston rods 42 and 44, respectively, which fit within a central opening 46 of the insulating core 28. The upper and lower fixtures 38 and 40 firmly grip the commutator shell in a known initial circumferential orientation dependent on the position of at least one of the arms 34. Thereafter, a circular saw blade 48 traverses an upward and subsequent downward path while cutting a slot 30 in the shell 32. In an exemplary embodiment, the saw blade 48 accurately cuts the slots having a width 19/1000ths of an inch across. Subsequent to cutting a slot 30, a stepper motor 50 precisely and automatically rotates the shell to a position for the next slot to be cut. The exact amount of rotation is dependent upon the number of commutator segments 26 to be provided in the resulting commutator 18. Accordingly, the operation continues until the appropriate number of slots are cut into the shell 32. In the illustrated embodiment ten slots are cut. Therefore, the stepper motor accurately rotates the commutator 36° after making each out.

Subsequently, a bending apparatus (not shown) turns the arms 34 into the hook members 30, previously discussed. The hook members 20 receive ends of the armature windings 16 which are electrically and mechanically connected thereto by, for example, welding. A completed commutator 18 is thusly illustrated in FIG. 4.

Referring to FIG. 5, a typical prior art method of assembling a commutator 18 to an armature shaft 12 is illustrated. This method is implemented by an automated mass production assembly machine (not shown) which sequentially positions an armature shaft and press fits a commutator thereon. Typically, the machine operates at a higher production rate than could be accomplished manually.

An armature core 14 is provided on the shaft 12. A fixture (not shown) of the assembly machine clamps the armature shaft with the armature poles 22 and slots 24 in a known predetermined circumferential orientation. A prior art nose-piece, or alignment fixture, 52 is also included as part of the assembly machine and comprises a generally cylindrical, hollow shell including a plurality of axial slots equally spaced about the circumference at one end thereof. The spacing between slots 54 is determined according to the spacing between hooks 20 on the commutator 18 with the nose-piece slots 54 being of a width greater than the hook width.

The nose-piece 52 is positioned and held in the assembly machine so that a central axis of the nose-piece is in axial alignment with the shaft 12. Additionally, the nose-piece slots 54 are in a known circumferential orientation with respect to the predetermined position of the armature slots 24 and poles 22.

Thereafter, the commutator 18 is placed axially adjacent the nose-piece 52, between the nose-piece 52 and the armature shaft 12. The commutator 18 is then removed towards the nose-piece until it is inserted therein with the hooks 20 resting in the slots 54. Thus, the circumferential orientation of the hooks 20 is known. The nose-piece 52 with the commutator assembly 18 therein and the armature shaft 12 are then axially moved with respect to one another, by utilizing conventional controls for the assembly machine, so that the insulating core 28 of the commutator 18 is press-fit onto the armature shaft 12. This prior art method results in the hooks being in general, but not sufficiently accurate, alignment with the poles 22 of the armature core 14. The positions of the hook does not accurately reflect the position of the commutator slots for the reasons previously discussed. Therefore, such an assembly process utilizing the prior art nose-piece 52 results in an armature assembly 10 wherein the commutator slots 30 are not in precise alignment with the armature slots 24 thereby resulting in less efficient motor operation that is desirable. In fact, on a mass production assembly machine, such a prior art method can only insure that the commutator slots and armature slots are aligned within a 2° tolerance.

Referring to FIG. 6, a nose-piece 56 according to the present invention is illustrated. The nose-piece 56 includes an alignment fixture 58 and a preorientation fixture 60.

The alignment fixture 58 comprises a receptacle 62 having a front face 64. A cylindrical bore 66 is provided through the front face 64 of the receptacle 62. While the receptacle 62 shown is of cylindrical shape, the particular shape of the receptacle is not important to the present invention. The bore 66 provides an inner cylindrical side wall 68 and a rear wall 69 within the receptacle 62. The bore similarly defines a center line 70. The radius between the center line 70 and side wall 68 is predetermined to be greater than the radius of a commutator with which the alignment fixture 58 is to be used.

A plurality of elongated blades 72 of, for example, steel extend radially inwardly from the side wall 68. Each blade 72 has a width slight less than the width of the commutator slots. The blades 72 must be of a size to provide a loose enough fit within the commutator slots to enable movement therebetween, but yet a tight enough fit to maintain the commutator in proper circumferential orientation, as is described more specifically between. In the exemplary embodiment previously described herein, the slots are 19/1000" wide and the blades are 12/1000" wide. One blade 72 is provided for each such commutator slot.

Each blade 72 is sandwiched between a pair of opposing supporting members 74. Each supporting member 74 is secured to the inner cylindrical wall 68 by, for example, being force fit into cavities (not shown) provided in the side wall 68. The supporting members 74 support each blade in axial alignment with respect to the center line 70 and circumferentially spaced according to the circumferential spacing between the commutator slots. Thus, the supporting members must be precisely circumferentially positioned so that extremely precise circumferential orientation of the blade 72 is obtained. The blades 72 are circumferentially oriented so that when a commutator 18 is positioned in the aligned fixture, each blade coacts with a commutator slot 30 to axially slidably support the commutator in an accurate and known circumferential orientation. Accordingly, when the commutator is press-fit onto an armature shaft the commutator slots 30 are more accurately positioned with respect to the armature slots 24 than can reliably be obtained using the prior art nose-piece 52, discussed above. Particularly, the commutator slots and armature slots can be aligned to within a tolerance of ½° on a mass production basis.

While the alignment fixture 58 illustrated includes ten blades 72, only two such blades 72 are required. However, at least two of the blades should be in different planes, i.e. out of 180° alignment to assure the taking up of tolerances between blade width and slot width so that circumferential orientation within ½° tolerance occurs with assembly of substantially every commutator onto an armature shaft.

The alignment fixture 58 while aligning the commutator also acts as a means for testing for precise spacing between commutator slots and for insuring that the commutator has the correct number of slots, and thus also segments. If a commutator is not slotted properly, the spacing between slots will not be precise and the commutator 18 will be unable to enter the alignment fixture as the blade and slots would not line up properly.

The preorientation fixture 60 provides an initial rough orientation of the comutator prior to its insertion into the alignment fixture 58. The preorientation fixture 60 comprises a chassis or block 76 having a substantially cloverleaf-shaped passageway 78 therethrough. Additional notch areas 80 are provided on opposing ends of the cloverleaf-shaped passageway 78. The notch areas 80 are loosely toleranced to the tangs so as not to restrict circumferential commutator turning. The preorientation fixture is affixed to the alignment fixture 58 with screws 81 with its center line in substantial alignment with the center line 70 of the alignment fixture. Additionally, the notch openings 80 are positioned centrally between pairs of blades 72.

Accordingly, a commutator 18 may be inserted into the preorientation fixture 60 by axially inserting the commutator 18 into the preorientation fixture 60 and thereafter radially rotating the commutator 18 until the hooks 20 generally line up with the notch openings 80 and the cloverleaf-shaped opening 78. Subsequently, the commutator shell axially slidably moves through the preorientation fixture with the commutator slots 50 in general alignment with the blades 72, so that the commutator 18 may turn as necessary to enter the alignment fixture 58 with the blades 72 slidably entering the slots 30 until the commutator 18 rests against the bottom wall 69 of the bore 66.

Referring to FIG. 8, a method for assembling the commutator 18 onto the armature shaft 12, according to the present invention, is illustrated. The armature 14, mounted on the armature 12, is held in a known circumferential orientation by any known means, such as clamps, 82 which form part of an automated assembly machine, as previously discussed with reference to FIG. 5. The nose-piece 56 is provided and held in the assembly machine in a position by, for example, a clamping fixture 84, wherein the center line 70 of the nose-piece 56 corresponds with the center line of a shaft 12 of an armature held by the clamps 82. Additionally, the nose-piece 56 is circumferentially oriented in the machine so that the blades 72 are in a known predetermined circumferential orientation corresponding to the circumferential orientation of the armature slots 24 as determined by the clamp 82. In fact, to insure accuracy, this orientation must be within a tolerance of one half of a degree. The commutator 18 is then positioned between the nose-piece 56 and the armature shaft 12 and is then moved, by any known means, axially and radially into the preorientation fixture 60, as described above. Then the commutator 18 is axially slidably directed into the alignment fixture 58 such that the blades 72 engage the slots 30 to hold the commutator 18 in the predetermined circumferential orientation. Thereafter, relative axial movement is imparted between the nose-piece 56 and the clamp 82, by the assembly machine, to press-fit the commutator shell insulating core 28 onto the armature shaft 12 wherein the commutator slots 30 are in precise circumferential alignment with respect to the armature slots 24 within a tolerance of one half of a degree.

It has been shown that by utilizing the accurate slotting operation and the alignment fixture according to the present invention, the commutator slots may be more precisely located within ½° with respect to the armature slots then resulted from the use of prior art alignment fixtures to provide a motor which operates in a more efficient manner.

While the embodiment described herein relates to an alignment fixture including a blade for each commutator slot, it is not intended that the present invention be so limited. In fact, it is believed that an alignment fixture including as few as two circumferentially spaced blades, as described above, would provide improved results as compared to previous devices utilized for assembling a commutator assembly to an armature shaft.

The preorientation fixture 60 according to the present invention is similarly not required in order to obtain the result described herein. In fact, the alignment fixture 58 could be utilized alone as a nose-piece assembly. The preorientation fixture 60, however, is intended to ease the insertion of the commutator assembly into the alignment fixture which feature is desirable in an automated assembly operation.

We claim:

1. An alignment fixture for holding a cylindrical commutator having equally circumferentially spaced axial slots when the commutator is press-fit onto an armature shaft so that the commutator slots are in circumferential alignment with slots on an armature which is carried by said shaft, said fixture comprising:

a receptacle having a front face with a cylindrical bore therethrough, the bore having a cylindrical wall and a center line, with a radius between said center line and said wall which is greater than the radius of a commutator;

a plurality of elongated blades, each said blade having a width less than the width of the commutator slots; and means associated with said bore wall for supporting said blades in axial alignment with respect to said center line and circumferentially spaced according to the circumferential spacing between the slots on a commutator and the slots on an armature, wherein said blades coact with said commutator slots to axially slidably support a commutator in a known circumferential orientation relative to the armature slots when the commutator is press-fit onto an armature shaft.

2. The alignment fixture of claim 1 wherein one blade is provided for each commutator slot.

3. The alignment fixture of claim 1 wherein said blades are equally circumferentially spaced from one another.

4. The alignment fixture of claim 1 wherein at least two of said blades are not in the same plane.

5. The alignment fixture of claim 1 wherein said blades are of a width to provide a loose enough fit within said commutator slots to allow for relative axial movement therebetween, but to also provide a tight enough fit therebetween to maintain the commutator in circumferential orientation.

6. The alignment fixture of claim 1 wherein said bore further defines a back wall of said receptacle perpendicular to said cylindrical side wall which acts as an axial support for a commutator which is inserted into the fixture.

7. The alignment fixture of claim 1 further comprising means for preorienting a commutator so that the commutator slots are in general alignment with said blades.

8. The alignment fixture of claim 7 wherein said preorientation means comprises a chassis having an opening therethrough with the shape of said opening being determined so that a commutator having outwardly extending hooks may pass therethrough.

9. The alignment fixture of claim 8 wherein said opening in said preorientation means includes a pair of notches openings positioned to receive a pair of tangs on a commutator.

10. A method of assembling a motor armature comprising the steps of:

providing an armature core having a plurality of circumferentially spaced slots carrying electrical windings and being mounted to an armature shaft;

providing an annular commutator shell having an insulating core with a central longitudinal opening molded therein;

cutting a plurality of longitudinal, equally circumferentially spaced slots in said commutator shell, with the number of slots equalling the number of armature slots;

supporting said armature shaft so that the armature slots are in a predetermined circumferential orientation;

radially and axially directing said commutator shell into an alignment fixture, said alignment fixture including a plurality of orientation blades for coacting with said commutator slots to hold said commutator in a predetermined circumferential orientation relative to said known orientation of said armature slots; and imparting relative axial movement between said alignment fixture and said armature shaft to press fit said commutator shell onto said armature shaft while maintaining circumferential alignment of the slots in the commutator and the armature wherein said commutator slots are in circumferential alignment with said armature slots.

11. The method of claim 10 further comprising the step of axially slidably supporting said commutator in said alignment fixture with said blades engaging said commutator slots.

12. The method of claim 10 further comprising the step of providing an alignment fixture having a cylindrical bore with said blades circumferentially spaced therein in axial alignment with a center line of said bore.

13. The method of claim 12 wherein said providing step includes the step of providing at least two of said blades being in different planes.

14. The method of claim 10 further comprising the step of preorienting the radial circumferential position of said commutator shell, prior to directing it into said alignment fixture, according to the circumferential orientation of the turned arms.

15. The method of claim 10 wherein said cutting step comprises the steps of supporting said commutator shell with its central longitudinal opening in a known axial position and radially aligning said commutator shell according to the circumferential position of at least one axial outwardly extending arm thereon, cutting a first longitudinal slot in said commutator shell, radially rotating said commutator shell a precise amount using a stepper motor and thereafter cutting a subsequent longitudinal slot, and continuing the latter two steps until a necessary number of longitudinal slots have been cut in said commutator shell.

16. A method of mounting a commutator to an armature shaft having an armature core mounted thereon, said core having a plurality of circumferentially spaced slots defining poles for carrying electrical windings thereon wherein said armature shaft is supported so that the armature slots are in a known circumferential orientation, said method comprising the steps of:

supporting an alignment fixture including a plurality of circumferentially spaced orientation blades in a predetermined circumferential orientation relative to said known orientation of said armature slots;

inserting a commutator having a plurality of longitudinal, equally circumferentially spaced slots therein into said alignment fixture wherein said blades engage said commutator slots to axially slidably support said commutator; and imparting relative axial movement between said alignment fixture and said armature shaft to press fit said commutator onto said armature shaft while maintaining circumferential alignment of said blades and said armature slots so that said commutator slots are in circumferential alignment with said armature slots.

17. The method of claim 16 further comprising the step of radially preorienting the circumferential position of said commutator prior to inserting said commutator in said alignment fixture.

18. The method of claim 16 further comprising the step of providing an alignment fixture having a cylindrical bore with said blades circumferentially spaced therein in axial alignment with a center line of said bore.

19. The method of claim 18 wherein said providing step includes the step of providing at least two of said blades being in different planes.

* * * * *